US005269712A

United States Patent [19]

Denlinger et al.

[11] Patent Number: 5,269,712

[45] Date of Patent: Dec. 14, 1993

[54] LOW-FORCE RECEPTACLE CONTACT AND METHOD OF MAKING SAME

[75] Inventors: Keith R. Denlinger, Lancaster; John M. Myer, Millersville, both of Pa.

[73] Assignee: The Whitaker Corporation, Wilmington, Del.

[21] Appl. No.: 973,012

[22] Filed: Nov. 6, 1992

[51] Int. Cl.[5] ..... H01R 13/00

[52] U.S. Cl. ..... 439/845

[58] Field of Search ..... 439/845, 849, 850, 886, 439/887, 852

[56] References Cited

U.S. PATENT DOCUMENTS

| | | | |
|---|---|---|---|
| Re. 31,142 | 2/1983 | Simmons | 339/74 |
| 2,759,165 | 8/1956 | Batcheller | 439/849 |
| 3,975,079 | 8/1976 | Blakesley et al. | 439/887 |
| 4,026,627 | 5/1977 | Benasutti | 439/887 |
| 4,423,921 | 1/1984 | Hall | 439/849 |

*Primary Examiner*—Joseph H. McGlynn
*Attorney, Agent, or Firm*—Bruce J. Wolstoncroft

[57] ABSTRACT

A receptacle contact is provided in which small, noble-metal contacts are provide on the distal end portions of one or more cantilevered resilient beams located within a receptacle shell, by forming openings in the shell wall adjacent to the distal end portions of the beams and depositing the noble-metal on the thus-exposed distal end portions of the beams. The receptacle is made by providing a flat starting blank with a projection for each beam; the projections are folded inwardly, over the blank, and the main body of the blank then folded up to form the shell which surrounds the bent-up beams. The openings are formed in the blank at positions on the blank such that, after the bending operation is completed, they confront the distal end portions of the beams, as desired. Only then is the noble-metal deposit formed on the thus-exposed distal end portions of the beams.

14 Claims, 5 Drawing Sheets

LOW-FORCE RECEPTACLE CONTACT AND METHOD OF MAKING SAME

FIELD OF THE INVENTION

This invention relates to a receptacle contact which can be mated with and separated from its mating contact with a minimum of applied force, and to a method of making same. It relates particularly to such receptacle contacts which are to mate with header contacts in the form of blades, and in which the regions of contact with the blades are plated with a noble metal for excellent, long-term, low-resistance connection to the receptacle contact.

BACKGROUND OF THE INVENTION

Multi-contact plug and socket assemblies are well known and commonly used, particularly for connecting a first group of electrical leads or wires to a corresponding large group of leads or wires, for example in multiconductor connectors for use in digital systems.

When the number of plug and socket contacts becomes very large, e.g. of the order of 100 or more as an example, the force required to assemble and disassemble the connector can become quite high, e.g. 15 pounds or more, and this not only makes such connecting and disconnecting difficult for the One system which has been proposed to alleviate this problem uses a so-called jack-screw, mounted near the middle of the connector, with which the aligned contacts of plug and socket can be drawn together by turning of a screw extending between them. However, this construction is relatively expensive, and requires a substantial screwdriver operation to assemble and disassemble the connectors.

Another type of system has been proposed which requires no jack-screw, because only a very small force is needed to assemble and disassemble the plug and socket from each other. This system utilizes a plurality of so-called receptacle contacts. Each receptacle contact comprises a shell with enclosing sidewalls, and is open at least at one end. From the open end, at least one and preferably three resilient cantilevered contact beams extend obliquely within the shell; preferably also, the three beams comprise a central beam and two outboard beams, one on each side of the central beam. The resilient central beam extends obliquely within the shell from a first shell wall at the open end of the shell, toward the interior side of a second, opposite shell wall. More particularly, this central beam is biased by its own spring characteristic toward a position in which a free distal end portion thereof lies adjacent to the second shell wall. The two resilient outboard beams, one on each side of the central beam, extend obliquely within the shell from the open end of the second, opposite shell wall toward the first shell wall, and each is biased by its own spring characteristic toward a position in which a free distal end portion thereof lies adjacent to the first shell wall.

With this beam configuration, a blade contact can easily, and with minimal force, be inserted into the open end of the shell and advanced until the distal end portion of the central beam lies against one side of the inserted blade, and the distal portions of two outboard beams lie against the other side of the blade, thereby providing the desired contact between blade and beams.

In order to provide good, long-lived electrical contact between each beam and its corresponding inserted blade, a contact with a surface of a noble metal, such as gold, is preferably provided at the point on each beam where it contacts the corresponding blade. This can be done by coating the entire receptacle contact with a noble metal, such as gold, but this is expensive; however, it has not been feasible to coat just the distal tip of the beam with a noble metal, since it is inside the receptacle shell.

It has also been proposed to make the receptacle contact by bending up the shell and beams from a flat blank of resilient metal. This opens up the possibility of applying a localized deposit of noble metal on the distal end portions of the beams before the blank is bent up, and while they are accordingly exposed. However, if this is done, the mechanical manufacturing steps of stamping out the blank and bending it up into the form of a receptacle contact, with the cantilevered beams inside it must be interrupted after the stamping step so that a separate, localized plating process can be performed, and the locally plated blank must then be returned to mechanical processing. Not only does this introduce delay and inconvenience into the fabrication process, but it also requires special care in the mechanical processing so that the local noble-metal deposit is not injured during the rest of the mechanical processing.

It is an object of this invention to provide a receptacle contact for mating with a blade-type contact which requires only a small force for assembly and disassembly of the connector, and is relatively inexpensive to manufacture; it is also an object to provide a simple and inexpensive method of making such a receptacle contact.

SUMMARY OF THE INVENTION

In accordance with the invention, a receptacle contact is provided with openings through its shell which are adjacent to distal end portions of one or more cantilevered beams extending therein, and the desired local deposit of a noble metal is formed on that side of each beam which is exposed to the exterior of the shell by the openings. This permits the receptacle contact to be completely formed mechanically before deposition of the localized noble-metal occurs, whereby the expense involved in plating the entire receptacle is avoided, as is the manufacturing inconvenience and possible damage to the quality of the noble metal contact which arises if a localized deposit is formed on the beam before the receptacle is mechanically formed.

In a preferred embodiment, the receptacle contact is made from a flat blank of resilient metal having a projection along an edge for each beam which is to be formed; the one or more projections are bent inwardly over the blank and the blank bent around them to form a shell enclosing the one or more beams. An opening is provided at the appropriate place on the blank for each beam, such that when the blank is bent up to form the shell, there will be an opening through the shell wall adjacent to a distal portion of each beam.

In cases in which ends of the bent-up blank meet each other at a position where an opening is desired, a notch is preferably formed in each side edge of the original blank during the original stamping operation, such that when the blank is bent up, the two notches will confront each other and form the desired aperture.

The preferred embodiment uses one central beam which extends from the center of the edge of a first receptacle wall, obliquely toward the opposite wall, and a pair of outboard beams, one on each side of the central beam, each extending from the opposite wall toward the first wall. Also, a crimpable connector integral with the shell is preferably also provided for making contact to a wire, and is preferably formed along with the shell by providing an additional projection on the original blank at the opposite end thereof from the edge from which the beams extend, which additional projection is bent up to form a crimpable channel or trough for receiving a wire to be crimped within it.

In manufacture, the entire plug can be made from a single stamped-out metal blank having projections which will become the contact beams and the crimpable connector. The projections need only be folded inwardly to form the contact beams, the main body of the blank then folded up to form the shell around the beams, and the other projection bent up to form a trough for receiving the wires. Localized or spot plating onto the beams through the shell openings can then be performed to complete the device; this process is not only simple and inexpensive to perform, but is also economical, since only small amounts of gold need be deposited, rather than gold plating the entire surfaces of the beams; in addition, the plating can be done as a last step, after all of the stamping and bending is completed, so that the plating is protected from harm during such steps, and so that one need not interrupt the construction process to inject a plating process.

Accordingly, there is provided a receptacle contact which requires only a small force to effect mating and separation, and which is easy and economical to manufacture by the process described, and provides excellent, long-lived electrical contact.

BRIEF DESCRIPTION OF FIGURES

These and other objects and features of the invention will be more readily understood from a consideration of the following detailed description, taken with the accompanying drawings, in which.

DETAILED DESCRIPTION OF SPECIFIC EMBODIMENTS

Figure 1:
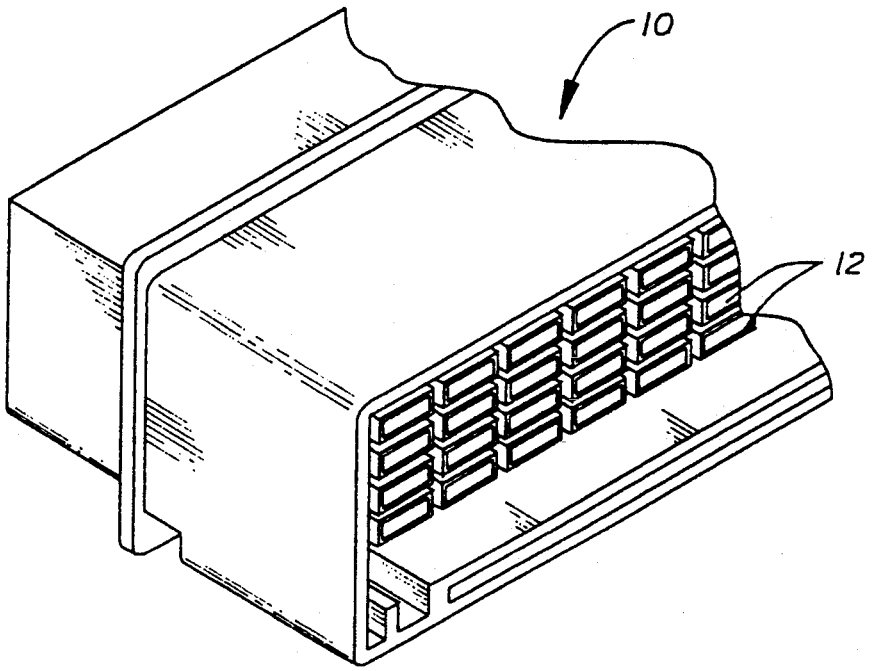
FIG. 1 is a fragmentary perspective view showing a portion of a connector in which a plurality of receptacle contacts according to the invention are installed.

Referring now to the embodiment of the invention shown in the drawings by way of example only, and without thereby in any way limiting the scope of the invention, FIG. 1 shows a portion of a conventional plug 10 in which a plurality of receptacle contacts such as 12 are installed. Each receptacle contact is to mate with a blade type of contact on a corresponding plug or header (not shown).

Referring now to FIGS. 2–6 showing the receptacle contact of the invention, an open-ended, box-like shell 13 of electrically conductive resilient material, such as phosphor bronze, is provided with a first, cantilevered contact beam 14 extending integrally from a first edge 15 of a bottom wall 16 of the shell 10. Beam 14 is centrally located laterally, along the bottom wall 16, and extends obliquely toward the opposite or top wall 18 of the shell, so that the distal portion 20 of beam 12 lies adjacent the upper wall 18. An opening 22 is provided in the top wall of the shell adjacent to the distal end portion 20 of beam 14 so as to expose it to the exterior. Upon this exposed distal end portion of beam 14 there is formed a metallic deposit 24, which preferably has an outer surface of a noble metal, such as gold, although it may have underlying layers of materials suitable for enhancing plating upon the underlying metal; for example, when the noble metal is gold, it is preferred to apply a plated layer of nickel to the distal end portion of beam 14, before plating the gold.

Outboard beams 30 and 32 extend integrally and obliquely from the upper edge 36 at the open end of the shell 13, so that their respective distal portions 38 and 40 lie adjacent the respective openings 42 and 44 in the bottom wall of the shell 10. Metallic deposits 46 and 48 are formed on the exposed distal portions of beams 30 and 32, as described above for the case of the central beam 14. Extending from the bottom wall 16 of the shell 13, and rearwardly thereof, is a crimpable connector trough 50, suitable for receiving a wire within it and which is to be crimped to form a good electrical contact with the wire, in conventional manner.

Figure 2:
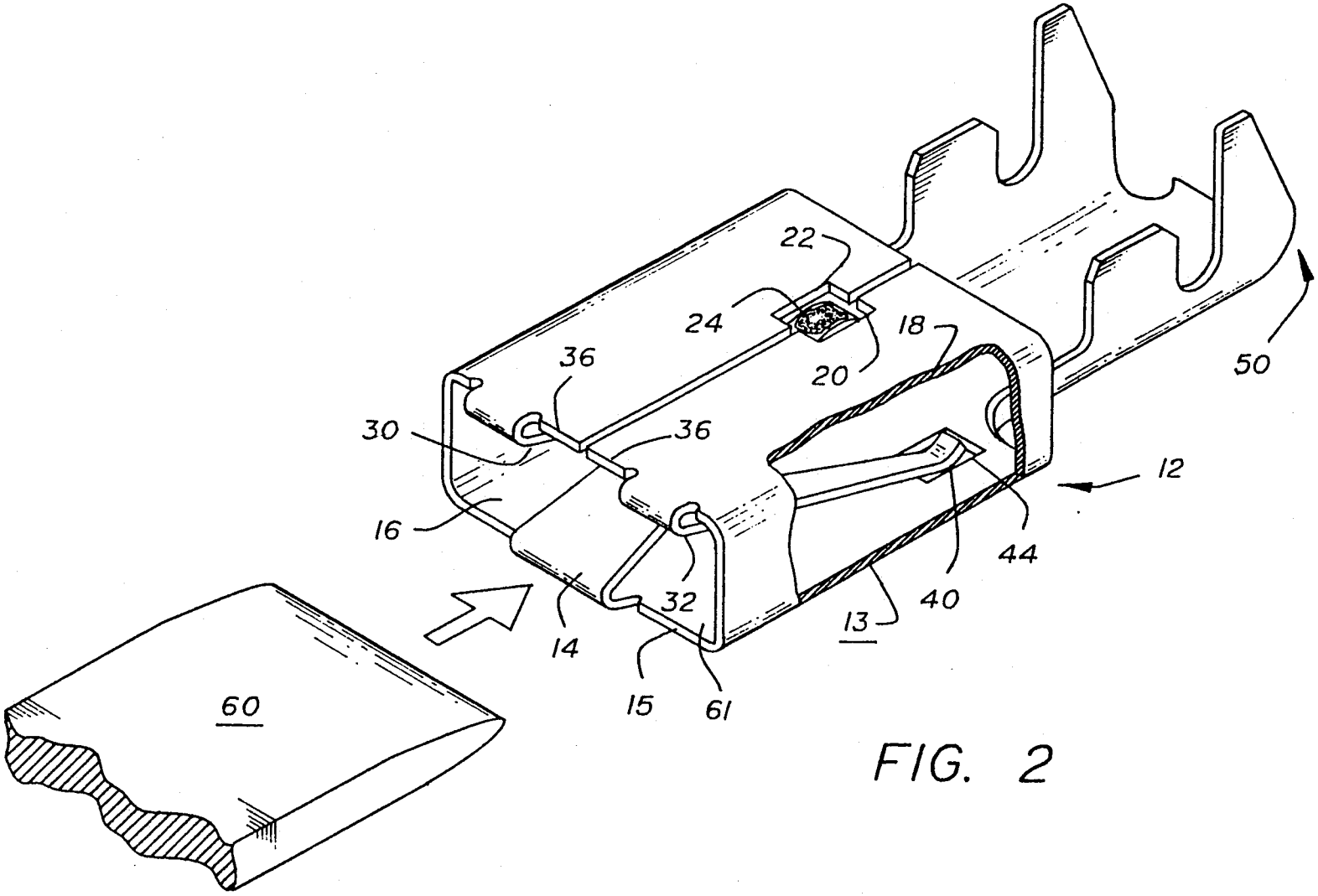
FIG. 2 is a perspective view of a receptacle contact according to this invention.
Figure 3:
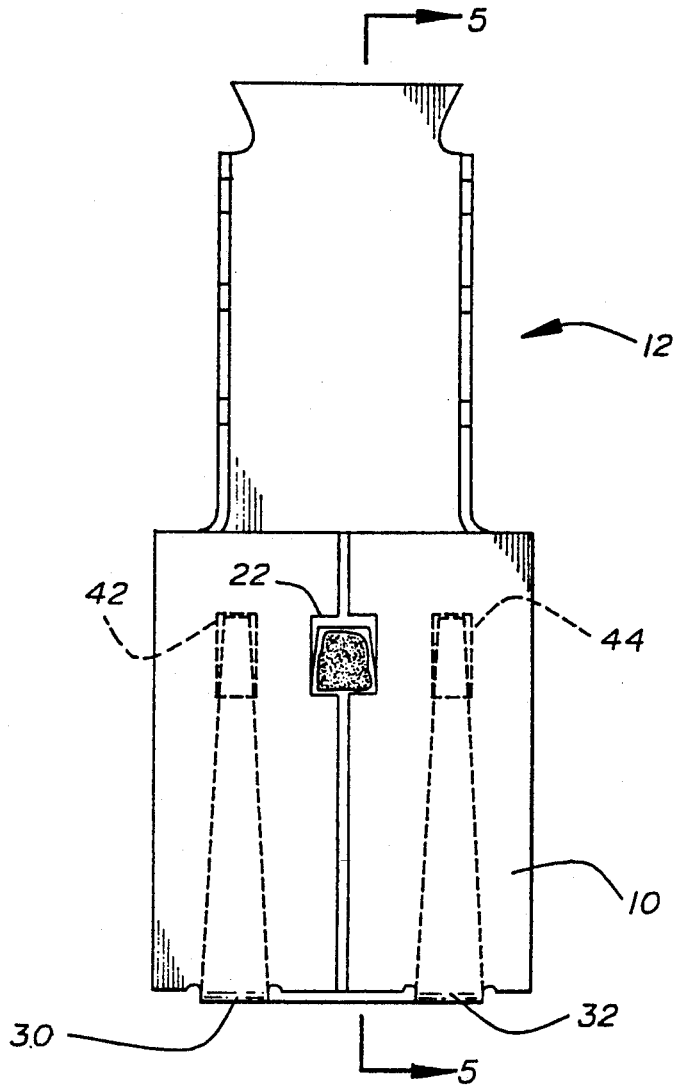
FIG. 3 is a plan view of the receptacle contact of the invention.
Figure 4:
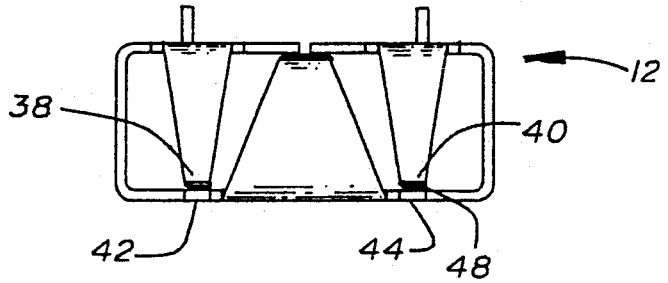
FIG. 4 is an end view of the receptacle of FIG. 3.
Figure 5:
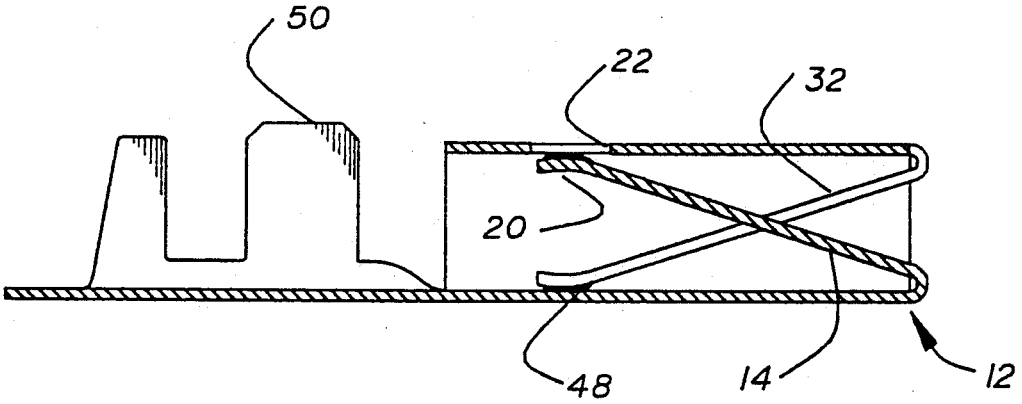
FIG. 5 is a vertical sectional view taken along lines 5—5 of FIG. 3, before a blade contact is introduced into it.
Figure 6:
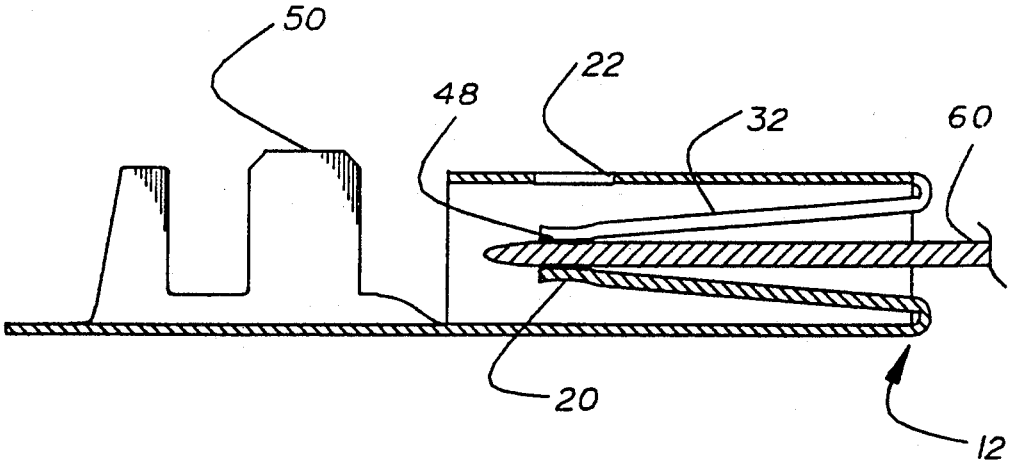
FIG. 6 is a view like that of FIG. 5, with a contact blade advanced into it.

Shown in FIG. 2 is a portion of a blade type contact 60 about to enter the receptacle contact. As illustrated in FIG. 6, advancing the blade contact 60 into the open end 61, between the central beam on the one hand and the two outboard beams on the other hand, causes the bottom, central beam 14 to bend progressively further downwardly, and the other two outboard beams to bend progressively further upwardly, as the blade contact slides along them until, when the blade contact is fully inserted as illustrated in FIG. 6, each of the noble-metal deposits 24, 46, 48 make respective contact with the blade.

The resilience of the contact beams is such that the blade is easily introduced into the receptacle contact, with a minimum of force, and similarly is removed with only a minimum of force being required. Accordingly, a connector using a large number of such receptacle contact as its contact elements can also be mated, assembled and separated easily, without, for example, requiring either a jack-screw or undue manual force.

Figure 7:
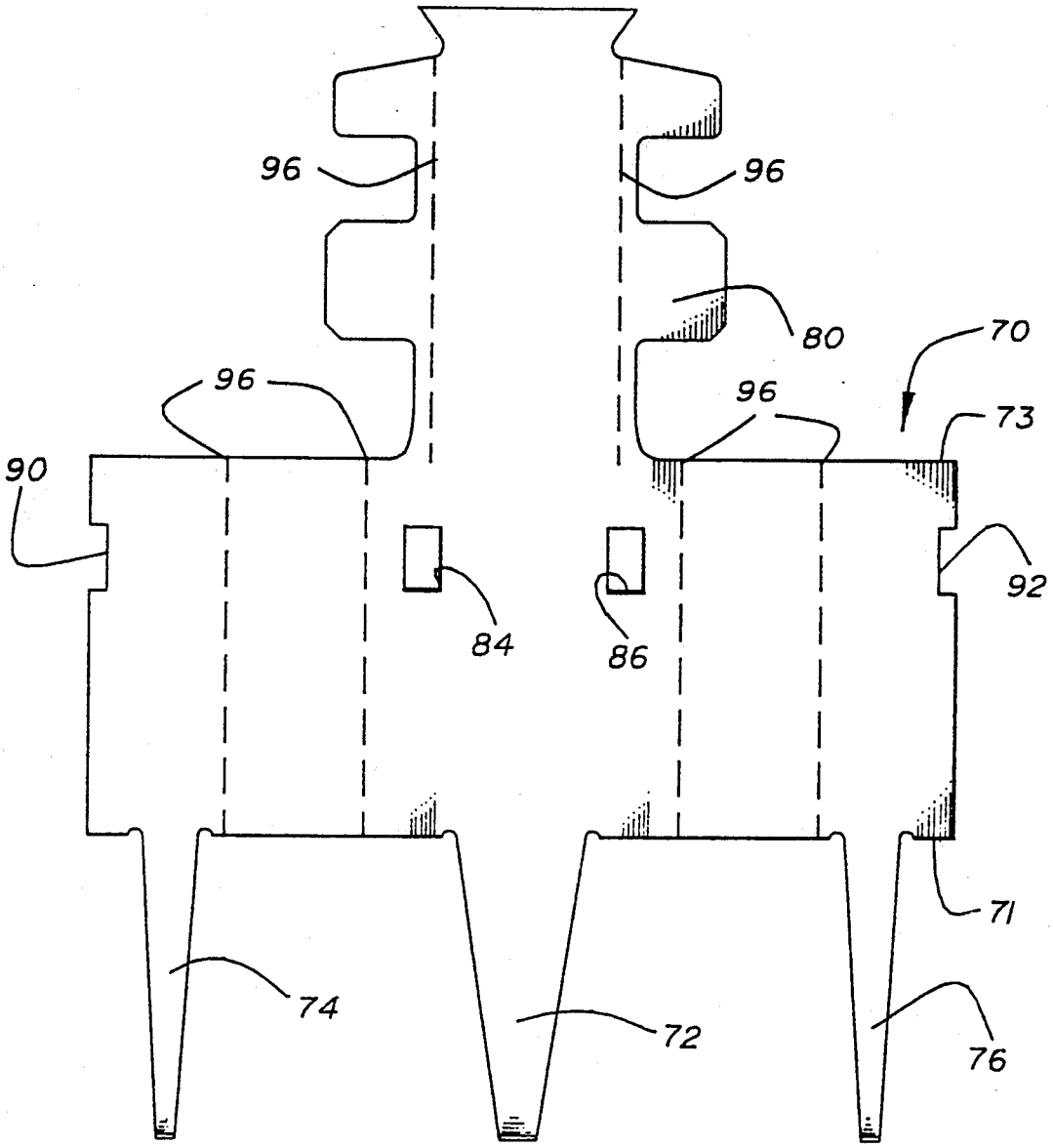
FIG. 7 is a plan view of a stamped blank from which the receptacle of the invention is preferably made.

Turning now to FIG. 7, in the preferred embodiment of the method of making the receptacle contact, one starts with a flat blank 70 of thin, resilient stock such as phosphor bronze sheet, stamped to create a central projection 72 extending integrally from its front edge 71, from which the central beam 14 will be formed; a pair of outboard projections 74 and 76 are similarly formed, and extend integrally from the same edge of the blank, from which projections the outboard beams 30 and 32 are later formed. From the rear edge 73 of the blank 70 there also extends another integral projection 80 having a form such that, when its edges are turned upwardly, it provides the desired crimpable trough 50 (FIG. 2) for receiving a wire to which it is to be electrically connected.

Openings 84 and 86 are provided in blank 70 at the positions shown, and will become openings 42 and 44 of the finished product of FIG. 2, for example. Similarly, the notches 90 and 92 in the opposite side edges of the blank are formed in positions such that when the shell is bent up, with its side edges substantially meeting along the top of the shell as shown in FIG. 2, the two notches 90 and 92 will confront each other and form the top aperture 22. The four lines along which the folds are made to form the shell are shown at 96 in FIG. 6.

Thus to form the receptacle connector of FIG. 1 according to the preferred form of the method of the invention, the blank shown in FIG. 7 is formed, as by stamping from phosphor bronze metal sheet; this stamping includes the formation of the various projections, the apertures and the notches. The three projections 72, 74 and 76 are then bent inwardly of the body of the blank so that they extend obliquely across it in the positions which they will assume in the finished receptacle. Next, folds are made along lines 96 to form the box-like shell 13, and the crimpable connector projection 80 is bent up along its sides to form the crimpable trough 50 of FIG. 2.

With the receptacle contact in this state of construction, all that is necessary is to form the noble metal contact on the distal end portions of the three beams, which are exposed to the exterior of the shell through their respective openings 22, 38 and 40. Any of a variety of conventional methods of forming such deposits may be employed. As an example only, one may employ the plating method known as a proximity cell, which is performed by standard electrode position techniques, although other procedures may be used.

A relative inexpensive receptacle contact is thereby provided which requires only small amounts of noble metal, and is easy and inexpensive to manufacture.

While the invention has been described with particular reference to specific embodiments in the interest of complete definiteness, it will be understood that it may be embodied in a variety of forms diverse from those specifically shown and described, without departing from the spirit and scope of the invention.

What is claimed is:

1. In a method of fabricating a receptacle contact which comprises a shell of resilient metallic material containing at least one integral, resilient, cantilevered beam extending therein with a distal end portion thereof positioned adjacent to a wall of said shell and with a localized metallic deposit on said distal portion, the improvement which comprises the steps of:

forming said metal deposit by providing an opening through said shell adjacent to said distal end portion of said beam to expose said distal end portion to the exterior, and thereafter applying said localized metallic deposit to the thus-exposed distal end portion of said beam.

2. The method of claim 1, wherein said receptacle contact comprises a plurality of integral, resilient, cantilevered beams each extending obliquely therein, each having a distal end portion positioned adjacent to a wall of said shell, and said method comprises the steps of providing a corresponding plurality of apertures through said shell adjacent to said distal portions of said beams to expose said distal end portions to the exterior, and thereafter applying a localized metallic deposit to each of the thus-exposed distal end portions of each of said beams.

3. The method of claim 1, wherein said metallic deposit has a noble metal exterior.

4. The method of claim 1, wherein said noble metal is gold.

5. The method of claim 1, wherein said shell and said cantilevered beam are produced by first forming a sheet-like blank of said resilient material with an integral projection extending from it, and folding up said blank to form said shell, with said projection extending obliquely within it to constitute said beam.

6. In a method of forming a receptacle contact by providing an integral projection on a resilient metal blank and bending up said blank and said projection to form a shell enclosing a contact beam, the improvement comprising:

providing an opening through said shell adjacent to a distal end portion of said beam in said shell, thereby to expose said distal end portion, and thereafter forming an electrically conductive deposit on the side of said distal portion of said beam which faces outwardly of said shell.

7. The method claim 6, wherein said forming of said deposit comprises plating said distal portion with gold while it is exposed to the exterior.

8. The method of fabricating a receptacle contact, which contact comprises a shell, at least one resilient beam extending obliquely therein, and a crimp connector at one end thereof, said method comprising:

forming a blank of resilient metal having at least a first projection extending from an edge thereof and foldable inwardly to a predetermined position with respect to said blank to form said beam and said blank being foldable to form a shell about said beam;

said blank having an opening through it positioned to lie adjacent the distal end of said beam when said beam is folded into said position;

said blank having an extension thereof at the opposite end of said blank from said projection, said extension being of a shape and size to form a crimpable connector when bent up at its edges;

folding said projection inwardly of said blank to provide said beam in said position thereof;

then folding said blank to form said shell with said beam therein, and bending up said extension to form said crimpable connector; and thereafter forming a metal deposit, through the opening, on the side of said distal end portion of said beam which faces exteriorly of said shell.

9. The method of fabricating a receptacle contact, comprising:

forming a flat blank of resilient sheet metal having a front edge, a rear edge and a pair of opposite side edges, and having a first integral projection extending from the center of said front edge thereof, having a second integral projection extending from said first edge on one side of said first projection, and having a third integral projection extending from said front edge on the other side of said first projection;

providing a first opening and a second opening extending through said blank;

providing a first notch in one of said side edges of said blank and a second notch in the opposite side edge of said blank;

folding said first, second and third projections inwardly of said blank thereby to form corresponding first, second and third obliquely-extending, cantilevered, resilient beams;

thereafter folding up said blank into a four-sided shell of rectangular cross-section, said shell having a bottom wall from which said first beam extends obliquely inside said shell, having a top wall from which said second and third beams extend obliquely inside said shell, and having side walls joining said top and bottom walls;

said openings and notches being positioned in said shell so that said first and second notches confront each other and together form an opening positioned adjacent a distal end portion of said first beam, so that said first opening is positioned adjacent a distal end portion of said second beam, and so that said third opening being positioned adjacent the distal end portion of said third beam, thereby to expose all of said distal end portions to the exterior; and thereafter forming a local deposit of noble metal on the side of each of said distal end portions which faces toward the exterior of said shell.

10. The method of claim 9, comprising also providing a fourth integral projection extending outwardly from said rear edge of said blank, and bending up the sides of said fourth projection about its longitudinal axis to form a trough suitable for crimping to a wire placed therein.

11. The method of claim 10, wherein said deposit comprises an exposed layer of gold.

12. The method of fabricating a receptacle contact of the type comprising a shell defining a cavity therein and having at least one open end; at least one resilient, electrically-conductive, cantilevered beam integral with said shell and extending obliquely from a first wall of said shell at a position adjacent to said open end, toward a second wall opposite to said first wall; and a metallic deposit of a noble metal on a distal end portion of said beam; said method comprising the steps of:

forming a blank of resilient metal having a first projection extending from an edge thereof and foldable inwardly of said blank to a predetermined position to form said beam, said blank being foldable to form said shell with said beam inside of it;

said blank also having an opening through it positioned to lie adjacent to a distal portion of said beam when said beam is folded into said predetermined position and said blank is folded to form said shell;

folding said projection inwardly of said blank to provide said beam in said predetermined position;

then folding said blank to form said shell with said beam therein; and thereafter forming a metal deposit, through the opening, on the side of said distal portion of said beam which faces outwardly of said shell.

13. A receptacle contact for providing mating connection with a blade contact, comprising:

a shell having sidewalls and at least one open end;

a first flexible, cantilevered, electrically-conductive beam extending obliquely inside said shell from a first location on a first sidewall of said shell at said open end of said shell toward a second sidewall of said shell opposite from said first sidewall, said first beam being biased toward a first position in which a distal end portion thereof lies adjacent said second sidewall;

second and third flexible, cantilevered electrically-conductive beams extending obliquely within said shell toward said first sidewall from second and third respective locations on the same end of said shell as said first beam but on said second wall, said second and third beams being biased toward respective first and second positions in which their respective distal end portions lie adjacent said first sidewall;

said second sidewall having an aperture through it immediately adjacent to said distal end portion of said first beam, and said first sidewall having a pair of apertures extending through it immediately adjacent to said distal end portions of said second and third beams;

whereby said distal end portions of said first, second and third beams are exposed to the exterior by said apertures to permit localized plating of metal thereon and said beams are responsive to insertion of a blade-type contact between said first beam on the one side and said second and third beams on the other side thereof to displace them, until one side of said blade is contacted by said first distal end portion of said first beam and the other side of said blade is contacted by said second and third distal end portions of said second and third beams.

14. The receptacle contact of claim 13, wherein said metal deposit has an exposed surface of noble metal.

* * * * *